US006193489B1

(12) United States Patent
Tarng et al.

(10) Patent No.: US 6,193,489 B1
(45) Date of Patent: Feb. 27, 2001

(54) SHAFT ASSEMBLY MECHANISM FOR SCROLL COMPRESSOR

(75) Inventors: Guang-Der Tarng; Lung-Tsai Chang, both of Hsin Chu Hsien (TW)

(73) Assignee: Rechi Precision Co., Ltd., Tao Yuan Hsien (TW)

( * ) Notice: Subject to any disclaimer, the term of this patent is extended or adjusted under 35 U.S.C. 154(b) by 0 days.

(21) Appl. No.: 09/432,262

(22) Filed: Nov. 2, 1999

(51) Int. Cl.[7] ..... F04C 18/04; F04C 29/02
(52) U.S. Cl. ..... 418/55.6; 418/94
(58) Field of Search ..... 418/55.1, 55.6, 418/94

(56) References Cited

U.S. PATENT DOCUMENTS 4,473,343 * 9/1984 Hazaki et al. ..... 418/55.1
4,545,747 * 10/1985 Tamura et al. ..... 418/55.1
5,358,392 * 10/1994 Ukai ..... 418/94
5,660,539 * 8/1997 Matsunaga et al. ..... 418/55.6
5,727,935 * 3/1998 Shigeoka et al. ..... 418/55.6

* cited by examiner

*Primary Examiner*—John J. Vrablik
(74) *Attorney, Agent, or Firm*—Rosenberg, Klein & Lee

(57) ABSTRACT

The present invention proposes a shaft assembly mechanism for a scroll compressor. An eccentric portion is installed at the top end of an eccentric shaft. A ring is lagged connectedly to the eccentric portion. A homocentrically arranged through hole is installed in the ring. The ring is lagged connectedly to the eccentric portion of the eccentric shaft via the through hole. A fixing hole is disposed at the bottom end of an orbiting scroll. A bushing is installed fixedly in the fixing hole. A through hole is installed in the bushing. A spiral oil groove for addition of lubricating oil is installed on the inner wall of the through hole of the bushing. The through hole of the bushing is lagged connectedly to the outer side of the ring. A shaft assembly mechanism of low noise, flexible assembly process, and easily controlled accuracy can thus be formed.

1 Claim, 6 Drawing Sheets

SHAFT ASSEMBLY MECHANISM FOR SCROLL COMPRESSOR

FIELD OF THE INVENTION

The present invention relates to a shaft assembly mechanism for a scroll compressor and, more particularly, to a shaft assembly mechanism which can reduce noise, let assembly process be more flexible, and let accuracy be easily controlled.

BACKGROUND OF THE INVENTION

In a scroll compressor, a stationary scroll and an orbiting scroll are meshed to form a plurality of closed spaces. The volume of the formed closed space decreases gradually from the outer edge toward the central part. As shown in FIGS. 1 and 2, an orbiting scroll 10 is led to orbit a stationary scroll 11 such that low-pressure working fluid a is sucked in via a suction port b, compressed through continuous orbital motion of the orbiting scroll 10, and discharged at high-pressure state via a discharge port c at the center of the stationary scroll 11. The compression stroke of working fluid is thus completed.

As shown in FIG. 3, a scroll compressor in prior art comprises an orbiting scroll 10, a stationary scroll 11, an isolating block 12, an Oldham ring 13, a frame 14, an eccentric shaft 15, a motor rotor 16, and a motor stator 17. The eccentric shaft 15 is tightly matched with the motor rotor 16. An axially passive ring 18 is installed at the top end of the eccentric shaft 15. When the motor is turned on, the eccentric shaft 15 is led to rotate by the motor rotor 16, and the orbiting scroll 10 is led to orbit eccentrically the center of the motor rotor 16 by the ring 18 at the top of the eccentric shaft 15. The Oldham ring 13 is installed at the top of the frame 14. When the orbiting scroll 10 is driven, the Oldham 13 can be used to control the orbiting scroll such that it can orbit but can not rotate on its axis. The orbiting scroll 10 is pressed by the stationary scroll 11 to stick to the frame 14. The stationary scroll 11 is fixed on the frame 14 via a passive blocking plate 19. The passive blocking plate 19 allows the stationary scroll 11 to make a little axial motion. The orbiting scroll 10 and the stationary scroll 11 respectively have a plurality of spiral scroll plates 20 and 21 with a plurality of compression rooms formed between them. The isolating block 12 is fixed in a shell 22 of the scroll compressor and partitions the shell 22 into a high-pressure chamber and a low-pressure chamber. A through hole 24 is disposed at the center of the isolating block 12 to connect the two chambers. When low-pressure working fluid is sucked into the compression rooms via a suction port b, the working fluid is pressed to be discharged via a through discharge port c at the center of the stationary scroll 11 through the continuous orbital motion of the orbiting scroll 10. High-pressure working fluid is then discharged out of the scroll compressor via an exit 23 at the shell 22 of the scroll compressor. However, in the above mentioned scroll compressor of prior art, another axially passive ring 18 needs to be lagged connectedly to the eccentric shaft 15. Gap between the ring and the eccentric shaft will be large because of the axially passive function, resulting in louder noise.

Another scroll compressor of prior art has no axially passive rings. But the eccentric shaft (not shown) is integrally formed such that consumed material is more. Molding and forging methods are needed for manufacture such that production cost is higher. Moreover, the eccentric shaft must be assembled in advance with the frame. Flexibility of assembly process is thus small.

SUMMARY AND OBJECTS OF THE PRESENT INVENTION

Accordingly, the primary object of the present invention is to provide a shaft assembly mechanism for a scroll compressor. A ring is lagged connectedly to an eccentric potion at the top end of an eccentric shaft of the scroll compressor. A through hole arranged homocentrically is installed in the ring. The ring is lagged connectedly to the eccentric potion of the eccentric shaft via the through hole. A fixing hole is disposed at the bottom end of the orbiting scroll. A bushing is fixed in the fixing hole. A through hole is disposed in the bushing. A spiral oil groove is installed on the inner wall of the through hole of the bushing for addition of lubricating oil. The through hole of the bushing is lagged connectedly to the outer side of the ring. The ring of the present invention is a homocentric circle such that accuracy can be easily controlled. Moreover, a spiral oil groove is installed in the bushing for addition of lubricating oil to solve the lubrication problem between the bushing and the corresponding ring. Axially passive function is nullified in the present invention, but the assembly gap between the ring and the eccentric shaft becomes smaller such that noise is reduced. Also, the eccentric shaft needs not be assembled in advance with the frame, resulting in larger flexibility of assembly process.

The various objects and advantages of the present invention will be more readily understood from the following detailed description when read in conjunction with the appended drawings, in which:

DETAILED DESCRIPTION OF THE PREFERRED EMBODIMENTS

Figure 1:
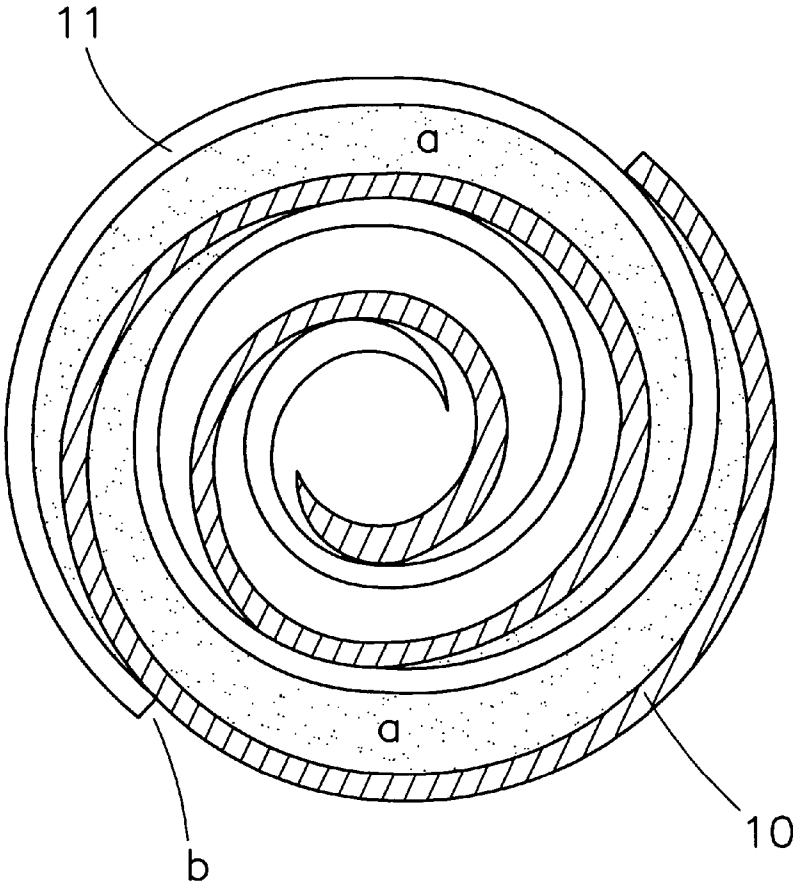
FIG.1 PRIOR ART
FIG. 1 is a diagram showing the operation principle of a scroll compressor in prior art.
Figure 2:
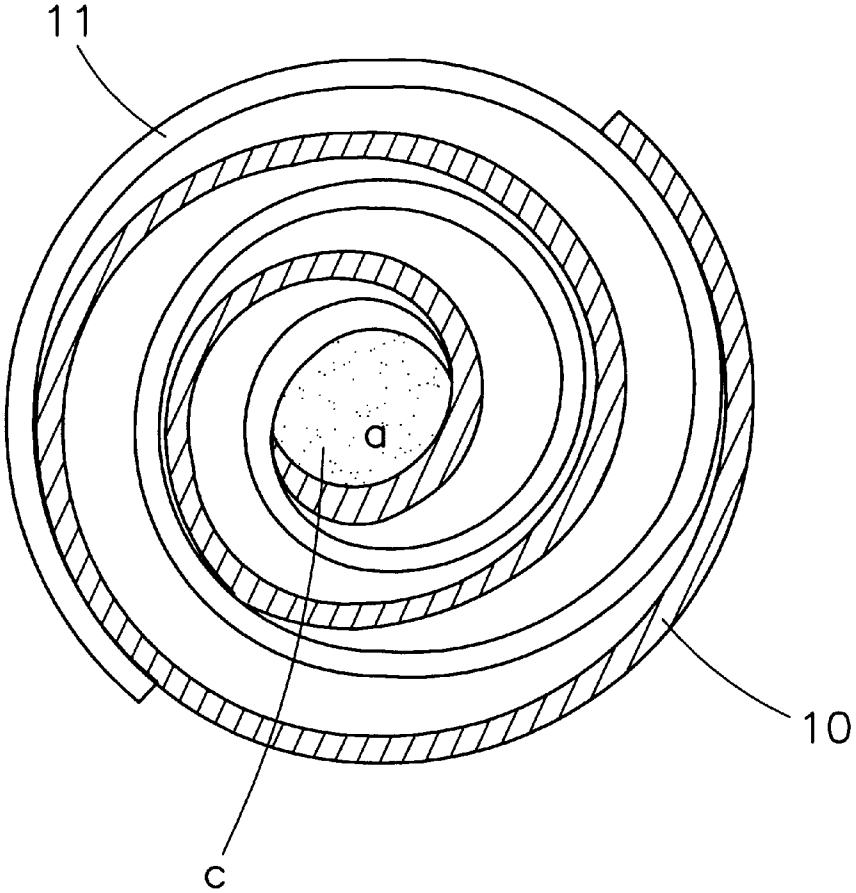
FIG. 2 PRIOR ART
FIG. 2 is another diagram showing the operation principle of a scroll compressor in prior art.
Figure 3:
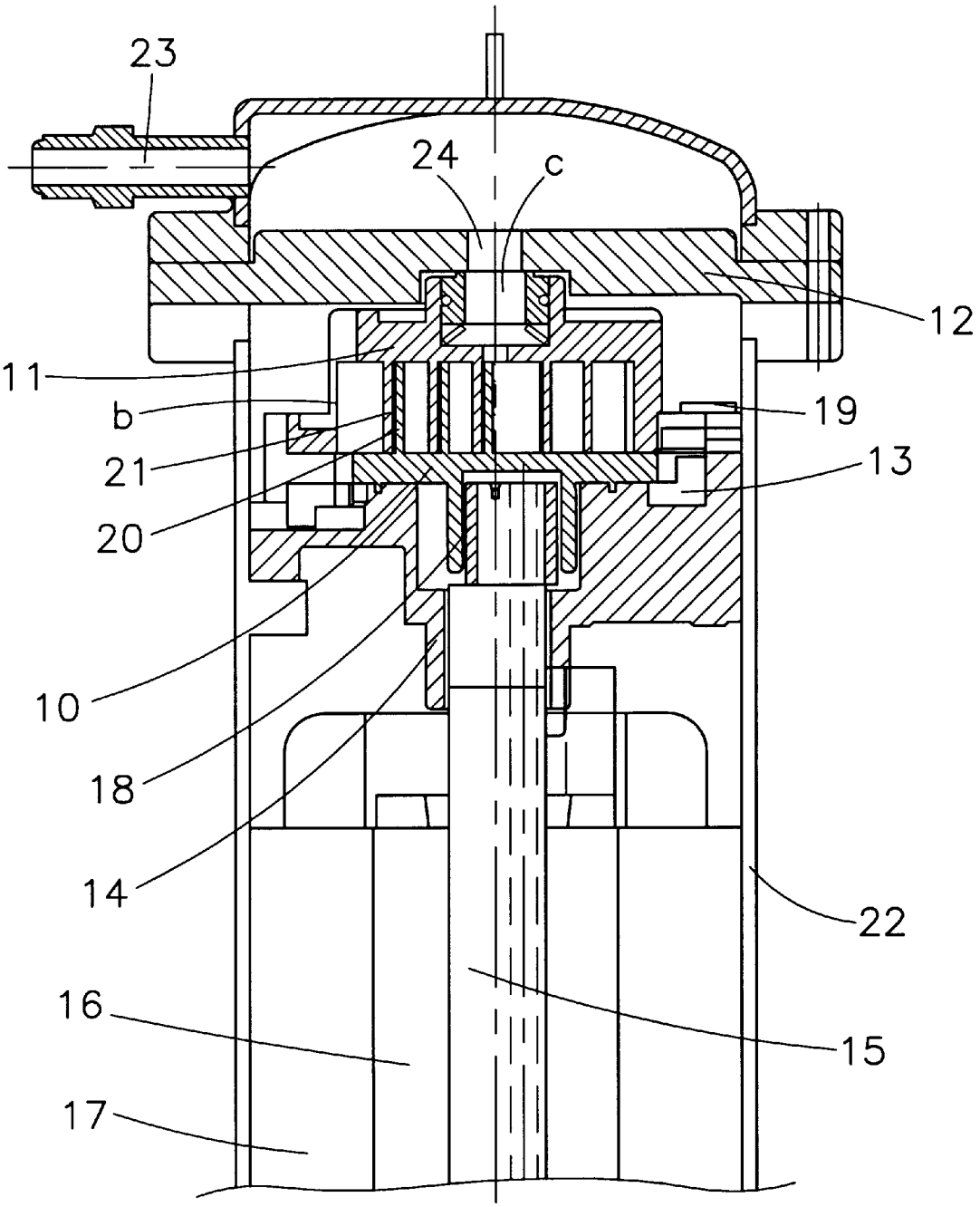
FIG.3 PRIOR ART
FIG. 3 is a cross-sectional view of a scroll compressor in prior art.
Figure 4:
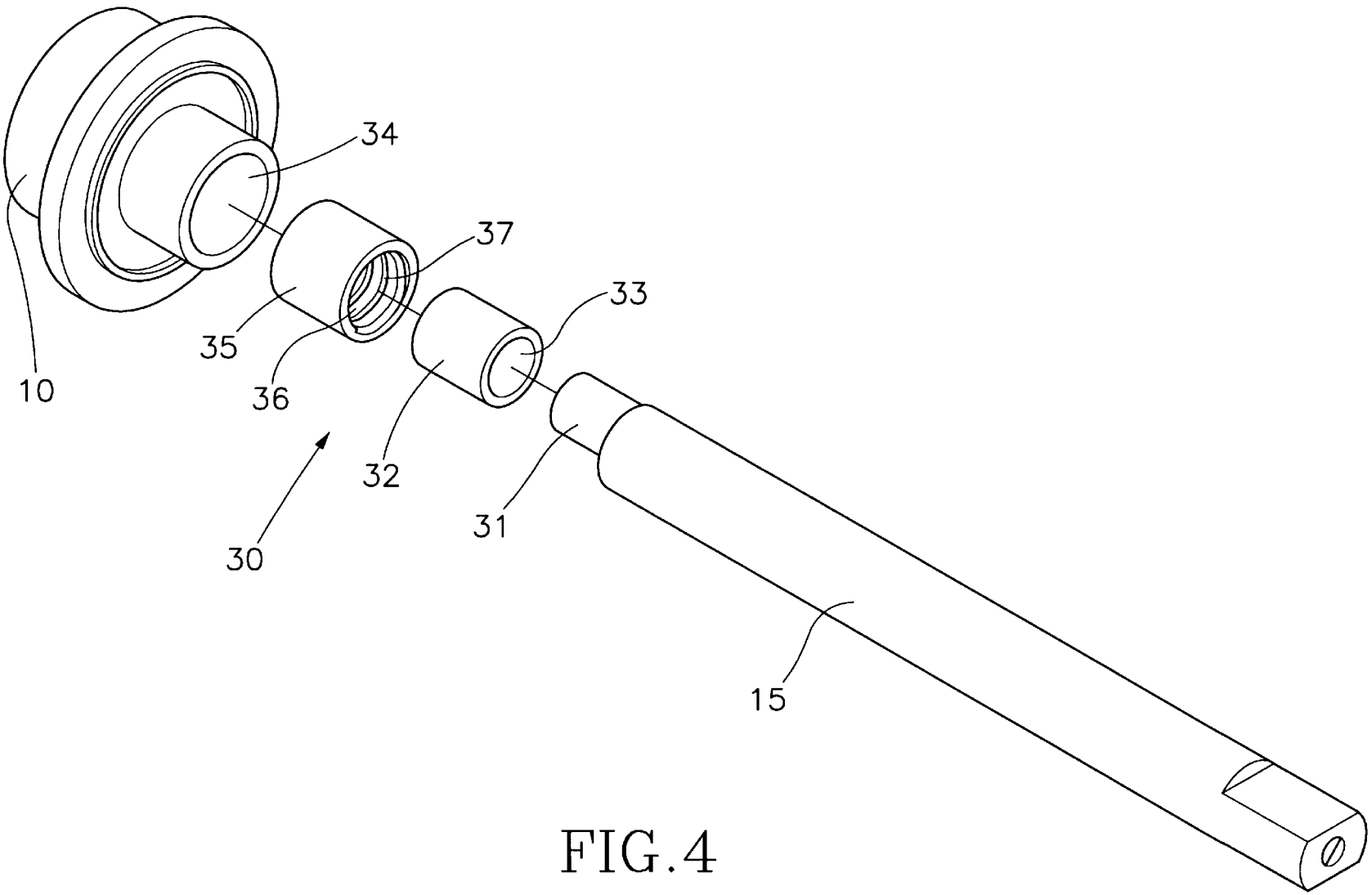
FIG. 4 is an exploded perspective view of the shaft assembly mechanism for a scroll compressor of the present invention.
Figure 5:
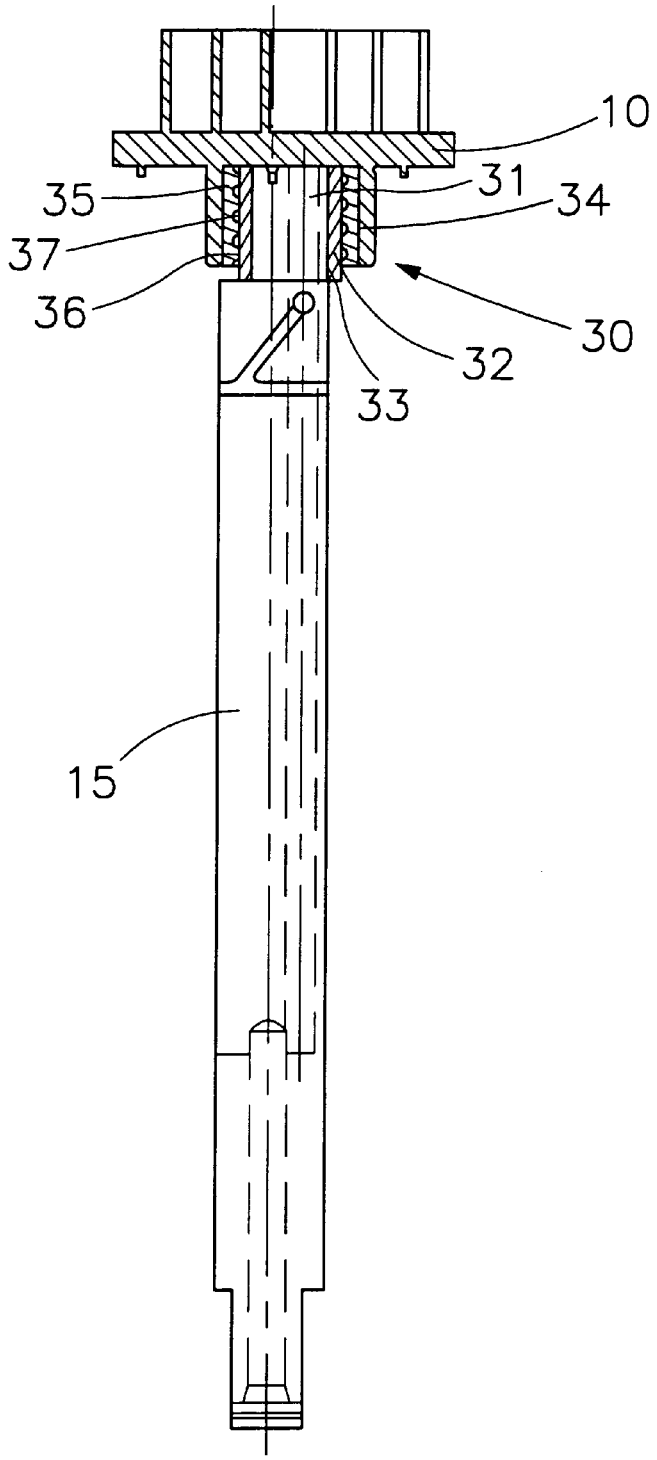
FIG. 5 is a cross-sectional assembly view of the shaft assembly mechanism for a scroll compressor of the present invention.
Figure 6:
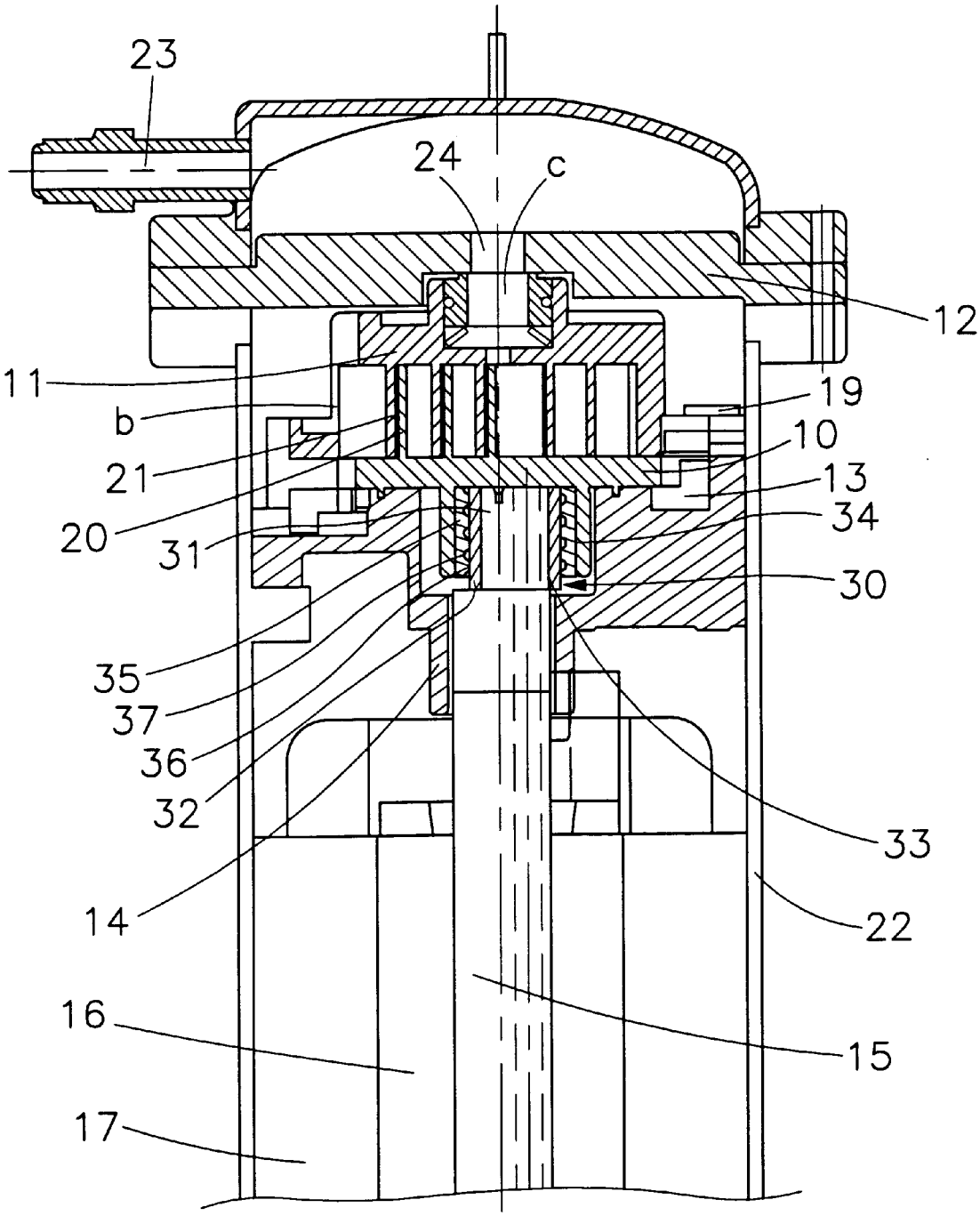
FIG. 6 is a cross-sectional view of the shaft assembly mechanism of the present invention when installed in a scroll compressor.

As shown in FIGS. 4 to 6, the present invention provides a shaft assembly mechanism for a scroll compressor. The scroll compressor comprises an orbiting scroll 10, a stationary scroll 11, an isolating block 12, an Oldham ring 13, a frame 14, an eccentric shaft 15, a motor rotor 16, and a motor stator 17. The eccentric shaft 15 is tightly matched with the motor rotor 16. The top of the eccentric shaft 15 is properly connected to the orbiting scroll 10. When the motor is turned on, the eccentric shaft 15 is led to rotate by the motor rotor 16, and the orbiting scroll 10 is led to orbit eccentrically the center of the motor rotor 16 through the top of the eccentric shaft 15. The Oldham ring 13 is installed at the top of the frame 14. When the orbiting scroll 10 is driven, the Oldham 13 can be used to control the orbiting scroll such that it can orbit but can not rotate on its axis. The orbiting scroll 10 is pressed by the stationary scroll 11 to stick to the frame 14. The stationary scroll 11 is fixed on the frame 14 via a passive blocking plate 19. The passive blocking plate 19 allows the stationary scroll to make a little axial motion. The orbiting scroll 10 and the stationary scroll 11 respectively have a plurality of spiral scroll plates 20 and 21 with a plurality of compression rooms formed between them. The isolating block 12 is fixed in a shell 22 of the scroll compressor and partitions the shell 22 into a high-pressure chamber and a low-pressure chamber. A through hole 24 is disposed at the center of the isolating block 12 to connect the two chambers. When low-pressure working fluid is sucked into the compression rooms via a suction port b, the working fluid is pressed to be discharged via a through discharge port c at the center of the stationary scroll 11 through the continuous orbital motion of the orbiting scroll 10. High-pressure working fluid is then discharged out of the scroll compressor via an exit 23 at the shell 22 of the scroll compressor.

The present invention is characterized in that a shaft assembly mechanism 30 is installed between the orbiting scroll 10 and the eccentric shaft 15 of the scroll compressor. An eccentric potion 31 is installed at the top end of the eccentric shaft 15. A ring 32 is lagged loosely to the eccentric portion 31. The ring 32 is a circular ring with an axial through hole 33 arranged homocentrically therein. The ring 32 is lagged loosely to the eccentric portion 31 of the eccentric shaft 15 via the through hole 33. A fixing hole 34 is disposed at the bottom end of the orbiting scroll 10. A bushing 35 is fixed tightly in the fixing hole 34. The hollow bushing 35 has an axial through hole 36 installed therein. A spiral oil groove 37 for addition of lubricating oil is installed on the inner wall of the through hole 36. The through hole 36 is lagged loosely to the outer side of the ring 32. A shaft assembly mechanism for a scroll compressor is thus formed. The ring 32 of the present invention can be made of steel or composite material. If the ring 32 is made of composite material, the bushing 35 can be replaced with the ring 32. The bushing 35 can thus be omitted while the ring 32 can be fixed directly in the fixing hole 34 of the orbiting scroll 10.

To sum up, the shaft assembly mechanism for a scroll compressor of the present invention has at least the following advantages:

1. The ring 32 of the present invention is a homocentric circle such that accuracy can be easily controlled.

2. The bushing 35 has a spiral oil groove 37 for addition of lubricating oil so as to solve the lubrication problem between the bushing 35 and the corresponding ring 32.

3. Axially passive function is nullified in the present invention such that the assembly gap between the ring 32 and the eccentric shaft 15 becomes smaller, resulting in smaller noise.

4. The eccentric shaft 15 need not be assembled in advance with the frame, resulting in larger flexibility of assembly process.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A shaft assembly mechanism for a scroll compressor, said shaft assembly mechanism being installed between an orbiting scroll and an eccentric shaft of said scroll compressor, an eccentric portion being installed at the top end of said eccentric shaft, a ring being lagged connectedly to said eccentric portion, a homocentrically arranged through hole being installed in said ring, said ring being lagged connectedly to said eccentric portion of said eccentric shaft via said through hole, a fixing hole being disposed at the bottom end of said orbiting scroll, a bushing being installed fixedly in said fixing hole, a through hole being installed in said bushing, a spiral oil groove for addition of lubricating oil being installed on the inner wall of said through hole of said bushing, said through hole of said bushing being lagged connectedly to the outer side of said ring.

* * * * *